US011776443B2

(12) United States Patent
Zhao et al.

(10) Patent No.: US 11,776,443 B2
(45) Date of Patent: Oct. 3, 2023

(54) GATE DRIVING CIRCUIT AND DRIVING METHOD THEREOF, DISPLAY PANEL AND DISPLAY DEVICE

(71) Applicants: Ordos Yuansheng Optoelectronics Co., Ltd., Inner Mongolia (CN); BOE TECHNOLOGY GROUP CO., LTD., Beijing (CN)

(72) Inventors: Jing Zhao, Beijing (CN); Xu Su, Beijing (CN); Shuang Zhao, Beijing (CN); Jigang Sun, Beijing (CN)

(73) Assignees: Ordos Yuansheng Optoelectronics Co., Ltd., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 438 days.

(21) Appl. No.: 17/052,251

(22) PCT Filed: Apr. 8, 2020

(86) PCT No.: PCT/CN2020/083659
§ 371 (c)(1),
(2) Date: Nov. 2, 2020

(87) PCT Pub. No.: WO2020/233265
PCT Pub. Date: Nov. 26, 2020

(65) Prior Publication Data

US 2023/0098375 A1 Mar. 30, 2023

(30) Foreign Application Priority Data

May 20, 2019 (CN) ..... 201910420435.4

(51) Int. Cl.
*G09G 3/20* (2006.01)

(52) U.S. Cl.
CPC ..... *G09G 3/20* (2013.01); *G09G 2300/0408* (2013.01); *G09G 2310/0267* (2013.01); *G09G 2310/08* (2013.01); *G09G 2330/021* (2013.01)

(58) Field of Classification Search
CPC ..... G09G 2310/0286; G09G 3/3677; G09G 2310/08
See application file for complete search history.

(56) References Cited

U.S. PATENT DOCUMENTS 9,875,706 B1 * 1/2018 Gong ..... G09G 3/3677
2004/0130542 A1 7/2004 Tanada
(Continued)

FOREIGN PATENT DOCUMENTS

CN 1885379 A 12/2006
CN 101093299 A 12/2007
(Continued)

OTHER PUBLICATIONS

CN103943085A Grid driving circuit, display device and driving method for zoning display Yang Dong Jul. 23, 2014 (Year: 2014).*
(Continued)

*Primary Examiner* — Van N Chow
(74) *Attorney, Agent, or Firm* — HOUTTEMAN LAW LLC

(57) ABSTRACT

There is provided a gate driving circuit including cascaded Gate Driver On Array (GOA) units, each GOA unit drives a row of pixels and includes a starting sub-unit, an output sub-unit and an output terminal, in the GOA unit at a first stage, the starting sub-unit is coupled with a starting signal, a first control signal, a second control signal and a constant voltage potential, and the output sub-unit is coupled with a first clock signal and a first power supply signal; in the GOA unit at an $n^{th}$ stage, the starting sub-unit is coupled with the starting signal, the first control signal, the second control
(Continued)

signal and the output terminal of the GOA unit at an $(n-1)^{th}$ stage, the output sub-unit is coupled with the first power supply signal and the output terminal of the GOA unit at an $(n+1)^{th}$ stage, n is an integer greater than 1.

10 Claims, 5 Drawing Sheets

(56) References Cited

U.S. PATENT DOCUMENTS

| | | | | |
|---|---|---|---|---|
| 2008/0036722 | A1 | 2/2008 | Uramoto et al. | |
| 2010/0128019 | A1 | 5/2010 | Harada | |
| 2016/0049208 | A1* | 2/2016 | Zheng | G11C 19/287 377/64 |
| 2017/0193943 | A1* | 7/2017 | Cao | H01L 27/1222 |
| 2018/0122318 | A1* | 5/2018 | Cao | G09G 3/3696 |
| 2018/0166029 | A1* | 6/2018 | He | G02F 1/136286 |
| 2019/0311690 | A1* | 10/2019 | Chen | G06F 3/0416 |
| 2020/0082776 | A1* | 3/2020 | Shi | G09G 3/3696 |

FOREIGN PATENT DOCUMENTS

| | | | |
|---|---|---|---|
| CN | 102855938 | A | 1/2013 |
| CN | 103680439 | A | 3/2014 |
| CN | 103943085 | A | 7/2014 |
| CN | 105513556 | A | 4/2016 |
| CN | 106531107 | A | 3/2017 |
| CN | 106601192 | A | 4/2017 |
| CN | 106782290 | A | 5/2017 |
| CN | 108231029 | A | 6/2018 |
| CN | 108831387 | A | 11/2018 |
| CN | 110136626 | A | 8/2019 |
| JP | 2000181414 | A | 6/2000 |
| KR | 20090027832 | A | 3/2009 |
| KR | 20160070445 | A | 6/2016 |

OTHER PUBLICATIONS

China Patent Office, First Office Action dated Jul. 1, 2020 regarding CN201910420435.4 and the English translation thereof.

* cited by examiner

GATE DRIVING CIRCUIT AND DRIVING METHOD THEREOF, DISPLAY PANEL AND DISPLAY DEVICE

CROSS-REFERENCE TO RELATED APPLICATIONS

The present application claims the priority of Chinese Patent Application No. 201910420435.4, filed on May 20, 2019, the contents of which are incorporated herein in their entirety by reference.

TECHNICAL FIELD

The present disclosure relates to the technical field of display, and in particular to a gate driving circuit and a driving method thereof, a display panel and a display device.

BACKGROUND

With the development of display technology, people have many new demands for display of display screens. The current display screen is designed by using, for example, a GOA (Gate driver On Array) scheme, however, in the existing GOA scheme, the gate driving circuit can only perform row-by-row scanning on a pixel array starting from a first row of pixels, which cannot be interrupted, and such design can only support the display screen to perform display as a whole, but cannot support the display screen to perform partial display.

Moreover, in the existing GOA scheme, the gate driving circuit can only operate as a whole, which may lead to resource waste and relative high energy consumption.

SUMMARY

An embodiment of the present disclosure provides a gate driving circuit for driving a pixel array, and the gate driving circuit includes a plurality of cascaded GOA units, each of the GOA units drives a row of pixels and includes a starting sub-unit, an output sub-unit and an output terminal which are sequentially coupled together, the starting sub-unit of the GOA unit at a first stage is further coupled with a starting signal, a first control signal, a second control signal and a constant voltage potential respectively, and the output sub-unit of the GOA unit at the first stage is coupled with a first clock signal and a first power supply signal respectively; the starting sub-unit of the GOA unit at an $n^{th}$ stage is coupled with the starting signal, the first control signal, the second control signal and the output terminal of the GOA unit at an (n−1)th stage respectively, the output sub-unit of the GOA unit at the $n^{th}$ stage is coupled with the first power supply signal and the output terminal of the GOA unit at an $(n+1)^{th}$ stage respectively, where n is an integer greater than 1, and in response to that n is an odd number, the output sub-unit of the GOA unit at the $n^{th}$ stage is further coupled with the first clock signal, in response to that n is an even number, the output sub-unit of the GOA unit at the $n^{th}$ stage is further coupled with the second clock signal, the gate driving circuit starts or stops scanning a corresponding row of pixels of the pixel array according to the first control signal, the second control signal and the starting signal.

In some implementations, the output sub-unit of the GOA unit at each stage includes: a first thin film transistor, a gate electrode and a source electrode of the first thin film transistor are coupled to each other; a second thin film transistor, a gate electrode of the second thin film transistor is coupled to a drain electrode of the first thin film transistor to form a first node, a source electrode of the second thin film transistor is coupled to the first clock signal or the second clock signal, and a drain electrode of the second thin film transistor is coupled to the output terminal of the GOA unit at a current stage; a third thin film transistor, a gate electrode of the third thin film transistor is coupled to the output terminal of the GOA unit at a next stage, a source electrode of the third thin film transistor is coupled to the first node, and a drain electrode of the third thin film transistor is coupled to the first power supply signal; and a fourth thin film transistor, a gate electrode of the fourth thin film transistor is coupled to the output terminal of the GOA unit at the next stage, a source electrode of the fourth thin film transistor is coupled with the drain electrode of the second thin film transistor, and a drain electrode of the fourth thin film transistor is coupled to the first power supply signal.

In some implementations, the starting sub-unit of the GOA unit at each stage includes a starting thin film transistor and a scanning thin film transistor, and in the starting sub-unit of the GOA unit at the first stage, a gate electrode of the starting thin film transistor is coupled with the second control signal, a source electrode of the starting thin film transistor is coupled with the starting signal, a drain electrode of the starting thin film transistor is coupled to the gate electrode of the first thin film transistor, a gate electrode of the scanning thin film transistor is coupled with the first control signal, a source electrode of the scanning thin film transistor is coupled with the constant voltage potential, and a drain electrode of the scanning thin film transistor is coupled to the gate electrode of the first thin film transistor; in the starting sub-unit of the GOA unit at the $n^{th}$ stage, a gate electrode of the starting thin film transistor is coupled with the first control signal, a source electrode of the starting thin film transistor is coupled with the starting signal, a drain electrode of the starting thin film transistor is coupled to the gate electrode of the first thin film transistor, a gate electrode of the scanning thin film transistor is coupled with the second control signal, a source electrode of the scanning thin film transistor is coupled to the output terminal of the GOA unit at the $(n-1)^{th}$ stage, and a drain electrode of the scanning thin film transistor is coupled to the gate electrode of the first thin film transistor.

In some implementations, the first clock signal and the second clock signal are out of phase by one-half clock cycle.

In some implementations, the constant voltage potential is a constant low voltage potential and the first power supply signal is a low level signal.

An embodiment of the present disclosure further provides a driving method of a gate driving circuit, which is applied to the gate driving circuit described in the foregoing embodiment, and the driving method includes: acquiring a display requirement; and adjusting the first control signal, the second control signal and the starting signal according to the display requirement to control the gate driving circuit.

In some implementations, the display requirement is to enable the gate driving circuit to perform row-by-row scanning on the pixel array starting from a first row of pixels, the first control signal is adjusted to be at a low level, the second control signal is adjusted to be at a high level, and the starting signal is adjusted to be at a high level to control the gate driving circuit to start the GOA unit at the first stage to scan the first row of pixels of the pixel array.

In some implementations, the display requirement is to enable the gate driving circuit to perform row-by-row scanning on the pixel array starting from the $n^{th}$ row of pixels, where n is an integer greater than 1, and before controlling the gate driving circuit to start scanning the $n^{th}$ row of pixels, the first control signal is adjusted to be at a low level, the second control signal is adjusted to be at a high level, and the starting signal is adjusted to be at a low level, and in response to that the gate driving circuit is controlled to start scanning the $n^{th}$ row of pixels, the starting signal of the GOA unit at the $n^{th}$ stage of the gate driving circuit is adjusted to be at a high level, the first control signal is adjusted to be at a high level, the second control signal is adjusted to be at a low level, and in response to that an output of the output terminal of the GOA unit at the $n^{th}$ stage of the gate driving circuit is changed to be at a high level, the first control signal is adjusted to be restored to the low level, the second control signal is adjusted to be restored to the high level, and the enable signal is adjusted to be restored to the low level.

In some implementations, the display requirement is to enable the gate driving circuit to stop scanning an $m^{th}$ row of pixels, where m is an integer greater than 1, and before controlling the gate driving circuit to stop scanning the $m^{th}$ row of pixels, the first control signal is adjusted to be at a low level and the second control signal is adjusted to be at a high level, to control the gate driving circuit to perform row-by-row scanning on the pixel array from the first row of pixels, in response to that an output of the output terminal of the GOA unit at the first stage of the gate driving circuit is changed to be at a high level, the starting signal is adjusted to be at a low level, in response to that an output of the output terminal of the GOA unit at an $(m-1)^{th}$ of the gate driving circuit is changed to be at a high level, the first control signal is adjusted to be at a high level and the second control signal is adjusted to be at a low level, the starting signal is kept at the low level, in response to that an output of the output terminal of the GOA unit at the $(m-1)^{th}$ stage of the gate driving circuit is changed to be at a low level, the first control signal is adjusted to be restored to the low level, the second control signal is adjusted to be restored to the high level, and the starting signal is kept at the low level to control the gate driving circuit to stop scanning the $m^{th}$ row of pixels.

In some implementations, the display requirement is to enable the gate driving circuit to perform scanning on the pixel array starting from an $n^{th}$ row of pixels and stopping at the $m^{th}$ row of pixels, n is an integer greater than 1, m is an integer greater than n, in response to that the gate driving circuit is controlled to start scanning the $n^{th}$ row of pixels, the starting signal of the GOA unit at the $n^{th}$ stage of the gate driving circuit is adjusted to be at a high level, the first control signal is adjusted to be at a high level, the second control signal is adjusted to be at a low level, in response to that an output of the output terminal of the GOA unit at the $n^{th}$ stage of the gate driving circuit is changed to be at a high level, the starting signal is adjusted to be at a low level, the first control signal is adjusted to be at a low level, the second control signal is adjusted to be at a high level, to control the gate driving circuit to perform row-by-row scanning on the pixel array starting from the $n^{th}$ row of pixels, in response to that an output of the output terminal of the GOA unit at the $(m-1)^{th}$ stage of the gate driving circuit is changed to be at a high level, the first control signal is adjusted to be at the high level, the second control signal is adjusted to be at the low level, so that the output of the output terminal of the GOA unit at the $(m-1)^{th}$ stage of the gate driving circuit cannot be input into the GOA unit at the $m^{th}$ stage of the gate driving circuit, the starting signal is kept at the low level, and is input into the GOA unit at the $m^{th}$ stage of the gate driving circuit, and an output of the output terminal of the GOA unit at the $m^{th}$ stage of the gate driving circuit is at a low level, to control the gate driving circuit to stop scanning the $m^{th}$ row of pixels.

An embodiment of the present disclosure further provides a display panel, which includes a pixel array and the gate driving circuit as described in the above embodiment, and the gate driving circuit is configured to drive the pixel array.

An embodiment of the present disclosure further provides a display device, which includes a housing and a display panel as described in the above embodiment, and the display panel is disposed in the housing.

An embodiment of the present disclosure further provides a gate driving circuit, configured to drive a pixel array, where the gate driving circuit includes a plurality of cascaded Gate driver On Array (GOA) units, the GOA unit at each stage drives a row of pixels, and the GOA unit at each stage includes a first thin film transistor, a second thin film transistor, a third thin film transistor, a fourth thin film transistor, a starting thin film transistor, and a scanning thin film transistor, a gate electrode and a source electrode of the first thin film transistor are coupled to each other; a gate electrode of the second thin film transistor is coupled to a drain electrode of the first thin film transistor to form a first node, a source electrode of the second thin film transistor is coupled with a first clock signal or a second clock signal, and a drain electrode of the second thin film transistor is coupled to an output terminal of the GOA unit at a current stage; a gate electrode of the third thin film transistor is coupled to the output terminal of the GOA unit at a next stage, a source electrode of the third thin film transistor is coupled to the first node, and a drain electrode of the third thin film transistor is coupled with a first power supply signal; a gate electrode of the fourth thin film transistor is coupled to the output terminal of the GOA unit at the next stage, a source electrode of the fourth thin film transistor is coupled to the drain electrode of the second thin film transistor, and a drain electrode of the fourth thin film transistor is coupled with the first power supply signal; in the GOA unit at the first stage, a gate electrode of the starting thin film transistor is coupled with a second control signal, a source electrode of the starting thin film transistor is coupled with a starting signal, a drain electrode of the starting thin film transistor is coupled to the gate electrode of the first thin film transistor, a gate electrode of the scanning thin film transistor is coupled with a first control signal, a source electrode of the scanning thin film transistor is coupled with a constant voltage potential, and a drain electrode of the scanning thin film transistor is coupled to the gate electrode of the first thin film transistor; in a starting sub-unit of the GOA unit at an $n^{th}$ stage, a gate electrode of the starting thin film transistor is coupled with the first control signal, a source electrode of the starting thin film transistor is coupled with the starting signal, a drain electrode of the starting thin film transistor is coupled to the gate electrode of the first thin film transistor, a gate electrode of the scanning thin film transistor is coupled with the second control signal, a source electrode of the scanning thin film transistor is coupled to the output terminal of the GOA unit at an $(n-1)^{th}$ stage, a drain electrode of the scanning thin film transistor is coupled to the gate electrode of the first thin film transistor, n is an integer greater than 1, in response to that n is an odd number, the source electrode of the second thin film transistor in the GOA unit at the $n^{th}$ stage is coupled with the first clock signal, and in response to that n is an even number, the source electrode of the second thin film transistor in the GOA unit at the $n^{th}$ stage is coupled with the second clock signal.

Additional aspects and advantages of the present disclosure will be set forth in part in the following description, will be obvious in part from the description, or may be learned by practices of the present disclosure.

DESCRIPTION OF EMBODIMENTS

Reference will now be made in detail to the embodiments of the present disclosure, examples of which are illustrated in the accompanying drawings, where like or similar reference signs refer to the same or similar elements or to elements having the same or similar functions. The embodiments described below with reference to the accompanying drawings are illustrative and intended to explain the present disclosure, and should not be construed as limiting the present disclosure.

A gate driving circuit and a driving method thereof, a display panel, and a display device of embodiments of the present disclosure are described below with reference to the accompanying drawings.

Figure 1:
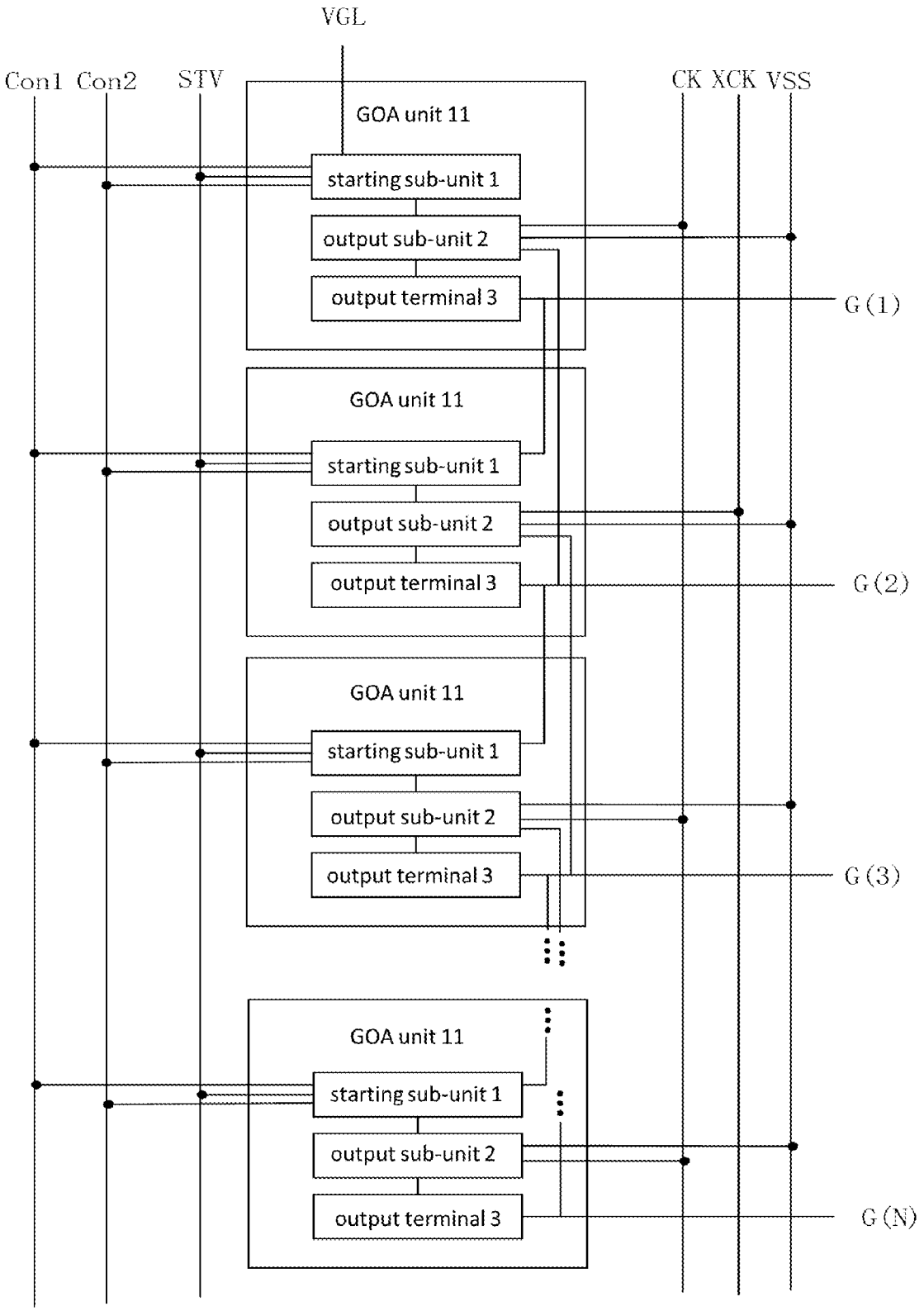
FIG. 1 is a schematic structural diagram of a gate driving circuit according to an embodiment of the present disclosure.

FIG. 1 is a block diagram of a gate driving circuit according to an embodiment of the present disclosure.

In the embodiment, the gate driving circuit is used for driving a pixel array, and as shown in FIG. 1, the gate driving circuit includes a plurality of cascaded GOA units 11, each GOA unit 11 drives a row of pixels, and each GOA unit 11 includes a starting sub-unit 1, an output sub-unit 2 and an output terminal 3, which are coupled in sequence.

Referring to FIG. 1, the starting sub-unit 1 of the GOA unit 11 at a first stage is coupled with a starting signal STV, a first control signal Con1, a second control signal Con2 and a constant voltage potential (e.g. a constant voltage low potential VGL) respectively, and the output sub-unit 2 of the GOA unit 11 at the first stage is coupled with a first clock signal CK, a first power supply signal (e.g. a low level signal VSS) and the output terminal 3 of the GOA unit 11 at a second stage respectively; the starting sub-unit 1 of the GOA unit 11 at the second stage is coupled with the starting signal STV, the first control signal Con1, the second control signal Con2 and the output terminal 3 of the GOA unit 11 at the first stage, respectively, and the output sub-unit 2 of the GOA unit 11 at the second stage is coupled with a second clock signal XCK, the first power supply signal (e.g. the low level signal VSS) and the output terminal 3 of the GOA unit 11 at a third stage, respectively; in this way, the starting sub-unit 1 of the GOA unit 11 at an $n^{th}$ stage is coupled with the starting signal STV, the first control signal Con1, the second control signal Con2, and the output terminal 3 of the GOA unit 11 at an $(n-1)^{th}$ stage, and the output sub-unit 2 of the GOA unit 11 at the $n^{th}$ stage is coupled with the first power supply signal (e.g., the low level signal VSS) and the output terminal 3 of the GOA unit 11 at the $(n+1)^{th}$ stage respectively, where n is an integer greater than 1 and less than or equal to N, N represents a total number of cascaded GOA units 11, in response to that n is an odd number, the output sub-unit 2 of the GOA unit 11 at the $n^{th}$ stage is further coupled with the first clock signal CK, and in response to that n is an even number, the output sub-unit 2 of the GOA unit 11 at the $n^{th}$ stage is further coupled with the second clock signal XCK. It should be noted that, in FIG. 1, G(n) represents a signal output from the output terminal 3 of the GOA unit 11 at the $n^{th}$ stage. In FIG. 1, the output sub-unit 2 of the GOA unit 11 at the $N^{th}$ stage is coupled with the first clock signal CK, so N is an odd number. It should be understood that if the output sub-unit 2 of the GOA unit 11 at the $N^{th}$ stage is coupled with the second clock signal XCK, then N is an even number.

In the embodiment, the GOA units 11 at each stage is coupled with the starting signal STV, the first control signal Con1 and the second control signal Con2, and the GOA unit 11 at each stage can start scanning or stop scanning according to the starting signal STV, the first control signal Con1 and the second control signal Con2, and thus the gate driving circuit can be controlled by the first control signal Con1, the second control signal Con2 and the starting signal STV to scan the pixel array in part, so as to perform a partial display, and when performing the partial display, it is not necessary to start all the cascaded GOA units 11, so that the gate driving circuit consumes less power while realizing the partial display by the pixel array.

Figure 2:
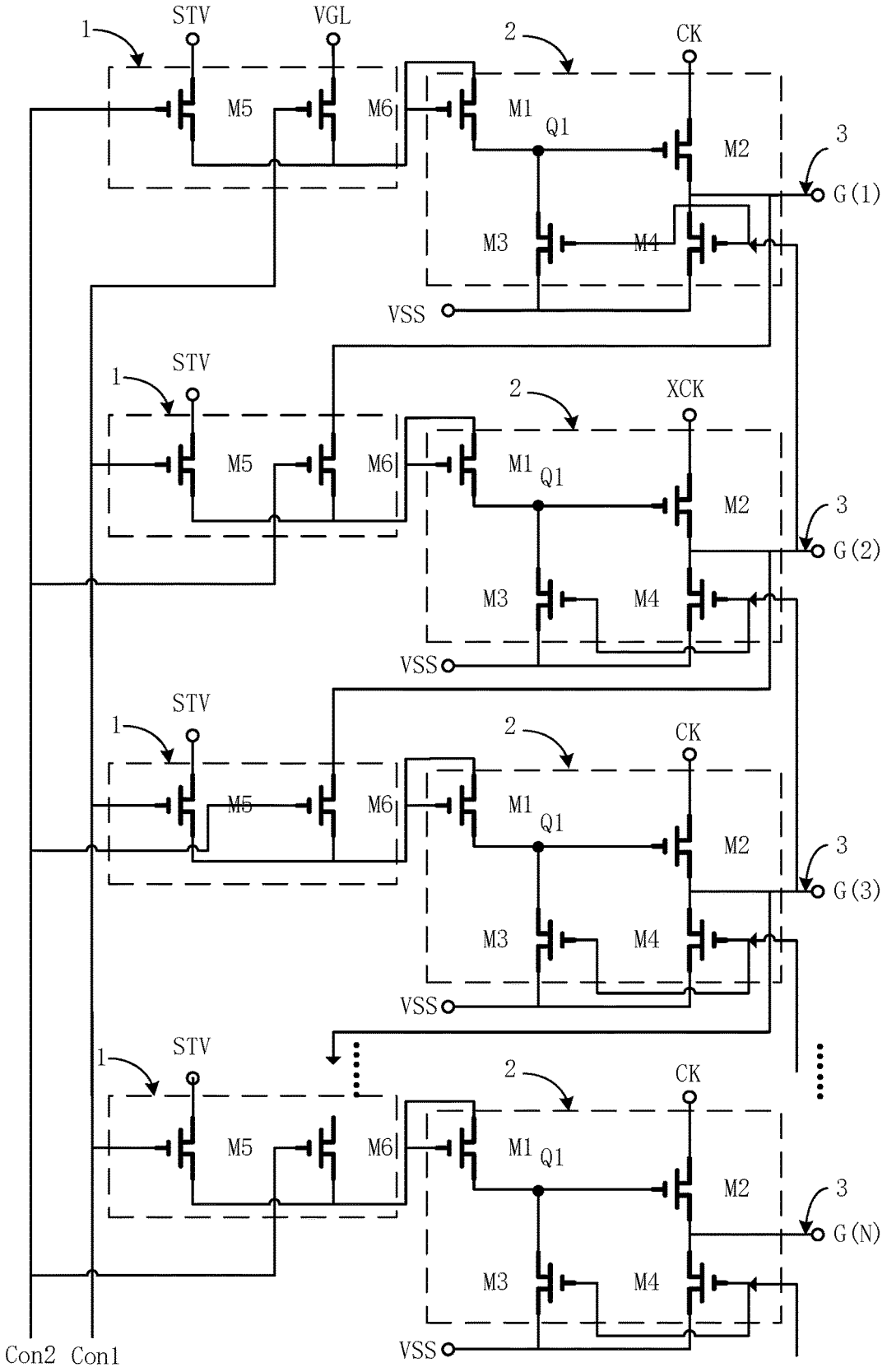
FIG. 2 is a circuit schematic diagram of a gate driving circuit according to an embodiment of the present disclosure.

In some implementations, as shown in FIG. 2, the output sub-unit 2 of the GOA unit 11 at each stage includes a first thin film transistor M1, a second thin film transistor M2, a third thin film transistor M3 and a fourth thin film transistor M4.

A gate electrode and a source electrode of the first thin film transistor M1 are coupled to each other, and a gate electrode of the second thin film transistor M2 is coupled to a drain electrode of the first thin film transistor M1 to form a first node Q1. A source electrode of the second thin film transistor M2 is coupled with the first clock signal CK or the second clock signal XCK (for example, the source electrode of the second thin film transistor M2 in the GOA unit 11 at the odd-numbered stage is coupled with the first clock signal CK, and the source electrode of the second thin film transistor M2 in the GOA unit 11 at the even-numbered stage is coupled with the second clock signal XCK), and a drain electrode of the second thin film transistor M2 is coupled to the output terminal of the GOA unit 11 at a current stage. A gate electrode of the third thin film transistor M3 is coupled to the output terminal of the GOA unit 11 at a next stage, a source electrode of the third thin film transistor M3 is coupled to the first node Q1, and a drain electrode of the third thin film transistor M3 is coupled with the low level signal VSS. A gate electrode of the fourth thin film transistor M4 is coupled to the output terminal of the GOA unit 11 at the next stage, a source electrode of the fourth thin film transistor M4 is coupled to the drain electrode of the second thin film transistor M2, and a drain electrode of the fourth thin film transistor M4 is coupled with the low level signal VSS. It should be noted that, since the GOA unit 11 at the $N^{th}$ stage is the GOA unit 11 at a last stage, both the gate electrode of the third thin film transistor M3 and the gate electrode of the fourth thin film transistor M4 of the output sub-unit 2 of the GOA unit 11 at the $N^{th}$ stage can be set.

In some implementations, as shown in FIG. 2, the starting sub-unit 1 of the GOA unit 11 at each stage includes a starting thin film transistor M5 and a scanning thin film transistor M6.

In the GOA unit 11 at the first stage, a gate electrode of the starting thin film transistor M5 is coupled with the second control signal Con2, a source electrode of the starting thin film transistor M5 is coupled with the starting signal STV, a drain electrode of the starting thin film transistor M5 is coupled to the gate electrode of the first thin film transistor M1, a gate electrode of the scanning thin film transistor M6 is coupled with the first control signal Con1, a source electrode of the scanning thin film transistor M6 is coupled with the constant voltage low potential VGL, and a drain electrode of the scanning thin film transistor M6 is coupled to the gate electrode of the first thin film transistor M1.

In the GOA unit 11 at the $n^{th}$ stage, a gate electrode of the starting thin film transistor M5 is coupled with the first control signal Con1, a source electrode of the starting thin film transistor M5 is coupled with the starting signal STV, a drain electrode of the starting thin film transistor M5 is coupled to the gate electrode of the first thin film transistor M1, a gate electrode of the scanning thin film transistor M6 is coupled with the second control signal Con2, a source electrode of the scanning thin film transistor M6 is coupled to the output terminal 3 of the GOA unit 11 at the $(n-1)^{th}$ stage, and a drain electrode of the scanning thin film transistor M6 is coupled to the gate electrode of the first thin film transistor M1, where n is an integer greater than 1 and less than or equal to N, and N represents the total number of cascaded GOA units 11.

Figure 3:
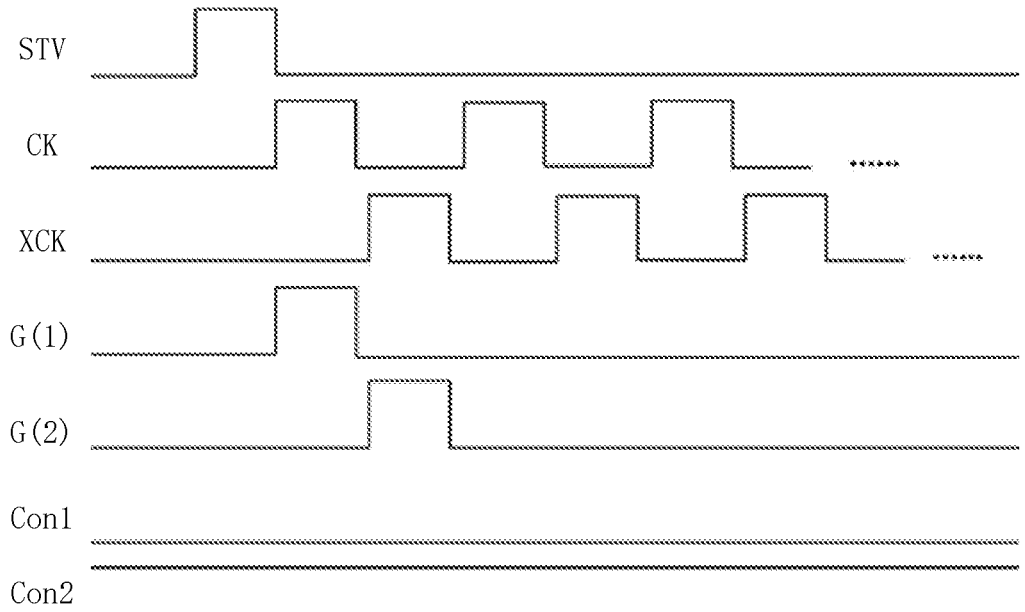
FIG. 3 is a signal timing diagram when a gate driving circuit according to an embodiment of the present disclosure performs row-by-row scanning on a pixel array from a first row of pixels.

It should be noted that, the source electrode and the drain electrode of each of the thin film transistors M1, M2, M3, M4, M5, and M6 may be interchanged. In the embodiment of the present disclosure, as shown in FIG. 3, the first clock signal CK and the second clock signal XCK are out of phase by one-half clock cycle. The starting thin film transistor M5 and the scanning thin film transistor M6 can be controlled by the first control signal Con1, the second control signal Con2 and the starting signal STV to be turned on or off, so as to control the GOA unit 11 at a corresponding stage to start scanning or stop scanning.

FIG. 3 shows a signal timing diagram when the gate driving circuit according to the embodiment of the present disclosure performs row-by-row scanning on the pixel array starting from a first row of pixels.

Specifically, referring to FIG. 3, when the first control signal Con1 is at a low level, the second control signal Con2 is at a high level, and the starting signal STV is at a high level, the GOA unit 11 at the first stage starts scanning the first row of pixels of the pixel array.

Specifically, when the first control signal Con1 is at the low level, the second control signal Con2 is at the high level, in the GOA unit 11 at the first stage, the scanning thin film transistor M6 is turned off, and the starting thin film transistor M5 is turned on; in the GOA unit 11 at any other stage, the scanning thin film transistor M6 is turned on, and the starting thin film transistor M5 is turned off. In this case, when the starting signal STV is at the high level, the starting thin film transistor M5 of the GOA unit 11 at the first stage enables the gate driving circuit to scan the first row of pixels, the GOA units 11 at remaining stages are not controlled by the starting signal STV, and the gate driving circuit performs scanning row by row in a manner consistent with a conventional scanning manner.

Figure 4:
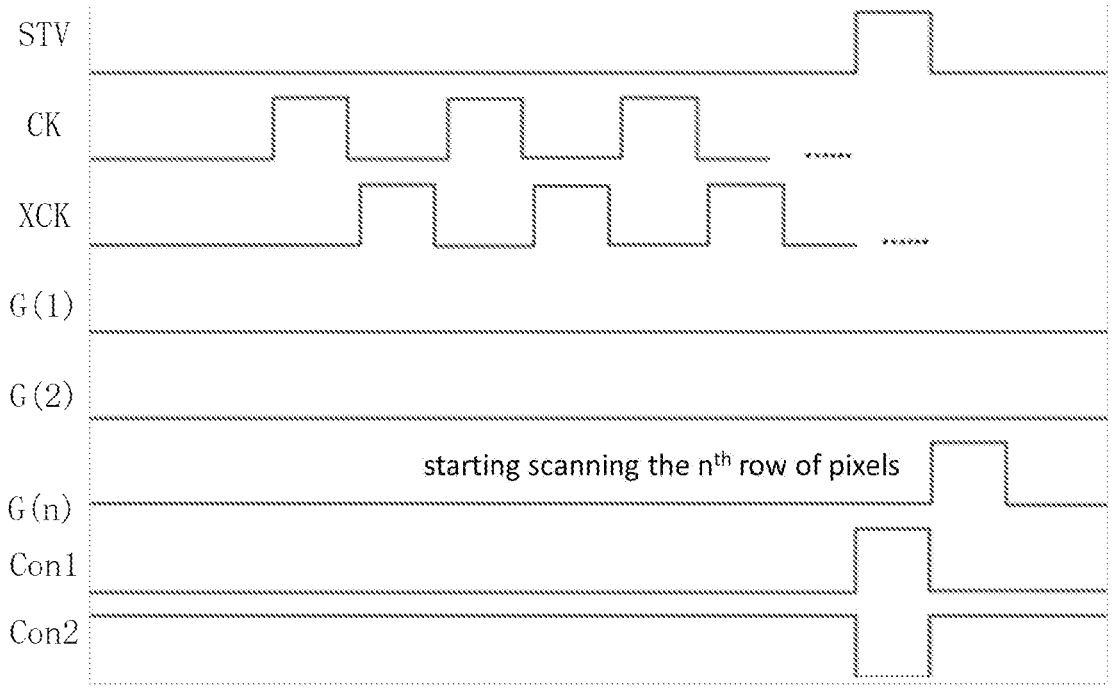
FIG. 4 is a signal timing diagram when a gate driving circuit according to an embodiment of the present disclosure performs scanning on a pixel array from an $n^{th}$ row of pixels.

FIG. 4 shows a signal timing diagram when the gate driving circuit of the embodiment of the present disclosure performs scanning on the pixel array from an $n^{th}$ row of pixels, where n is an integer greater than 1.

Specifically, as shown in FIG. 4, in a first time period, the first control signal Con1 is at a low level, the second control signal Con2 is at a high level, and the starting signal STV is at a low level; in a second time period, the starting signal STV is at a high level, the first control signal Con1 is at a high level, and the second control signal Con2 is at a low level; in a third time period, the first control signal Con1 is restored to be at the low level, the second control signal Con2 is restored to be at the high level, and the starting signal STV is restored to be at the low level.

Specifically, before starting scanning, the first control signal Con1 is at the low level, the second control signal Con2 is at the high level, and in the GOA unit 11 at the first stage, the scanning thin film transistor M6 is turned off, the starting thin film transistor M5 is turned on, and in the GOA unit at any other stage, the scanning thin film transistor M6 is turned on, and the starting thin film transistor M5 is turned off. At this time, when the starting signal STV is at the low level, the gate driving circuit would not start scanning. When starting scanning the $n^{th}$ row of pixels, in the GOA unit 11 at the $n^{th}$ stage, the starting signal STV is at the high level, the first control signal Con1 is at the high level, the second control signal Con2 is at the low level, the starting thin film transistor M5 is turned on, and the scanning thin film transistor M6 is turned off. At this time, the starting signal STV is input into the source electrode of the starting thin film transistor M5 in the GOA unit 11 at the $n^{th}$ stage, the signal G(n) output from the output terminal 3 of the GOA unit 11 at the $n^{th}$ stage is changed to be at a high level, and the gate driving circuit starts scanning on the $n^{th}$ row of pixels of the pixel array. When the signal G(n) output by the output terminal 3 of the GOA unit 11 at the $n^{th}$ stage is changed to be at the high level, the first control signal Con1 and the starting signal STV are restored to be at the low level simultaneously, and the second control signal Con2 is restored to be at the high level, so that in each of the GOA units 11 cascaded after the GOA unit 11 at the $n^{th}$ stage, the scanning thin film transistor M6 is turned on, the starting thin film transistor M5 is turned off, and the signal G(n) output by the output terminal 3 of the GOA unit 11 at the $n^{th}$ stage controls the GOA unit 11 at the $(n+1)^{th}$ stage to scan the $(n+1)^{th}$ row of pixels, and so on, and thus the gate driving circuit performs row-by-row scanning on the pixel array starting from the $n^{th}$ row of pixels.

Figure 5:
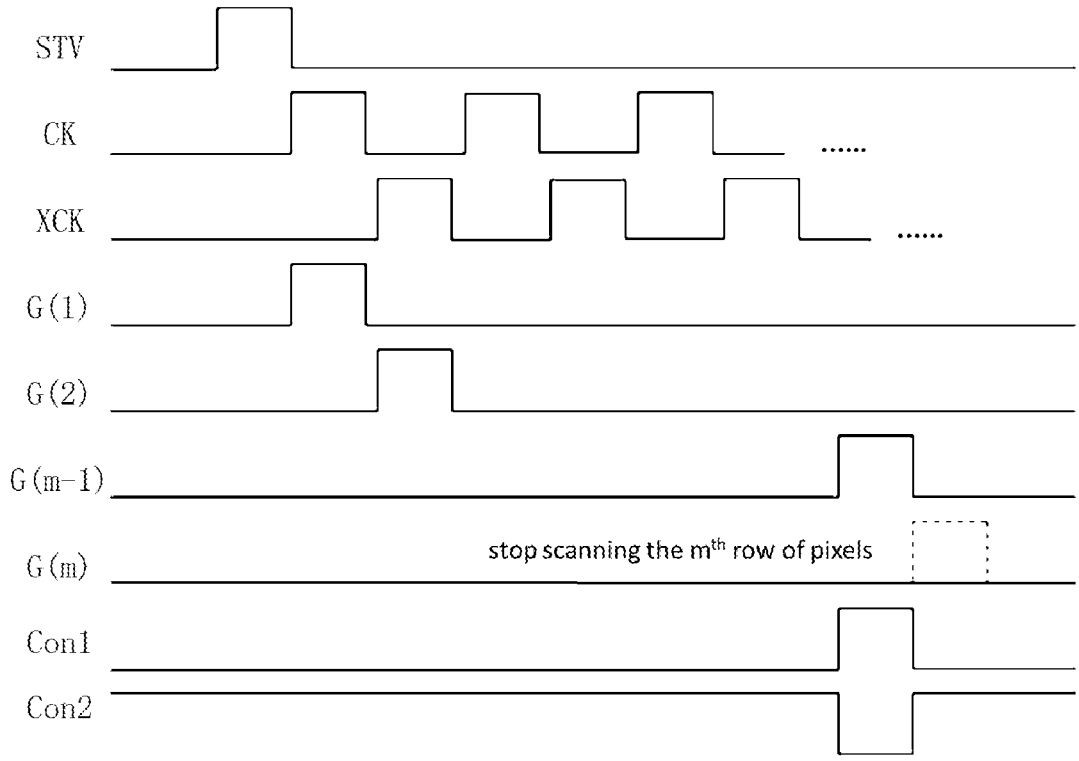
FIG. 5 is a signal timing diagram when a gate driving circuit according to an embodiment of the present disclosure stops scanning an $m^{th}$ row of pixels.

FIG. 5 shows a signal timing diagram when the gate driving circuit according to the embodiment of the present disclosure stops scanning an $m^{th}$ row of pixels, where m is an integer greater than 1.

Specifically, as shown in FIG. 5, in a first time period, the gate driving circuit performs row-by-row scanning on the pixel array starting from the first row of pixels, the first control signal Con1 is at a low level, the second control signal Con2 is at a high level, and when the signal G(1) output from the output terminal 3 of the GOA unit 11 at the first stage is changed to be at a high level, the starting signal STV is changed to be at a low level; in a second time period, the signal G(m−1) output by the output terminal 3 of the GOA unit 11 at the $(m-1)^{th}$ stage is at a high level, the first control signal Con1 is at a high level, the second control signal Con2 is at a low level, and the starting signal STV is kept at the low level; in a third time period, the signal G(m−1) output by the output terminal 3 of the GOA unit 11 at the $(m-1)^{th}$ stage is changed to be at a low level, and at the same time, the first control signal Con1 is restored to be at the low level, the second control signal Con2 is restored to be at the high level, and the starting signal STV is kept at the low level.

Specifically, the gate driving circuit performs row-by-row scanning on the pixel array from the first row of pixels to the $(m-1)^{th}$ rows of pixels, and during this period, the first control signal Con1 is kept at the low level, the second control signal Con2 is kept at the high level, and when the signal G(1) output from the output terminal 3 of the GOA unit 11 at the first stage is changed to be at the high level, the starting signal STV is changed to be at the low level. When the signal G(m−1) output from the output terminal 3 of the GOA unit 11 at the $(m-1)^{th}$ stage is changed to be at the high level, the first control signal Con1 is changed to be at the high level, the second control signal Con2 is changed to be at the low level, and in the GOA unit 11 at any other stage other than the first stage, the starting thin film transistor M5 is turned on and the scanning thin film transistor M6 is turned off, and at this time, the starting signal STV is kept at the low level, and is input into the source electrode of the starting thin film transistor M5 of the GOA unit 11 at the $m^{th}$ stage, and since the scanning thin film transistor M6 is turned off, the signal G(m−1) output from the output terminal 3 of the GOA unit 11 at the $(m-1)^{th}$ stage cannot be input into the GOA unit 11 at the $m^{th}$ stage. The signal G(m) output by the output terminal 3 of the GOA unit 11 at the $m^{th}$ stage is at a low level, and thus the gate driving circuit stops scanning the $m^{th}$ row of pixels.

Although FIG. 5 shows that the gate driving circuit performs row-by-row scanning on the pixel array starting from the first row of pixels and stopping at the $m^{th}$ row of pixels, it should be understood that the gate driving circuit according to the embodiment of the present disclosure may perform row-by-row scanning on the pixel array starting from an $n^{th}$ row of pixels and stopping at the $m^{th}$ row of pixels, and in this case, n is an integer greater than 1 and m is an integer greater than n.

Figure 6:
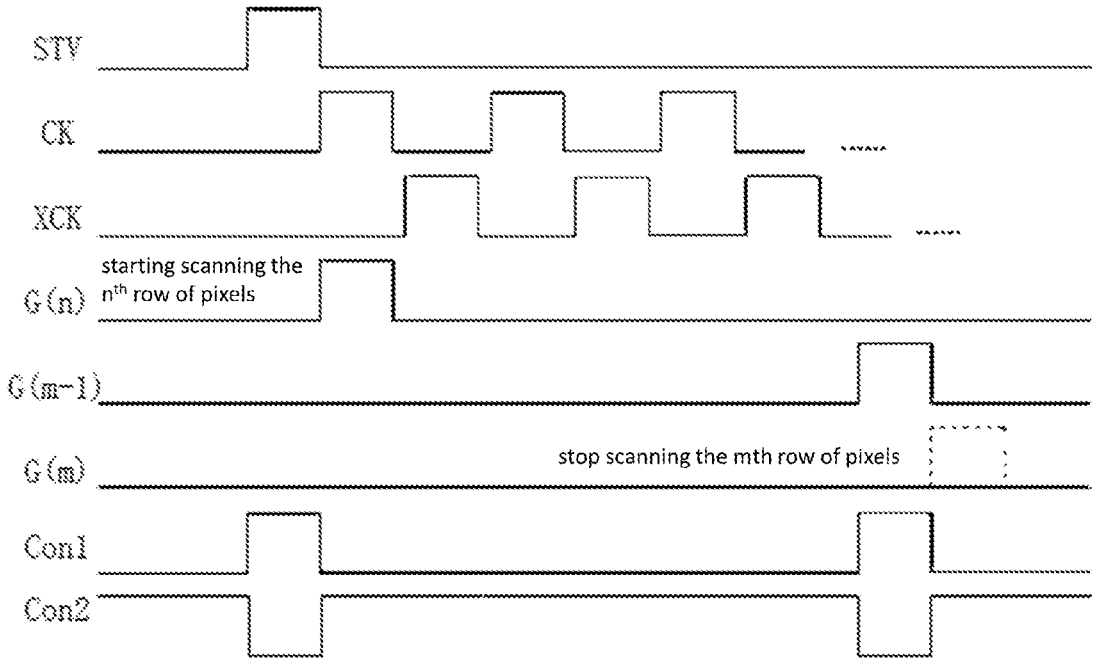
FIG. 6 is a signal timing diagram when a gate driving circuit according to an embodiment of the present disclosure performs scanning on a pixel array starting from an $n^{th}$ row of pixels and stopping at an $m^{th}$ row of pixels.

FIG. 6 shows a signal timing diagram when the gate driving circuit according to the embodiment of the present disclosure performs scanning on the pixel array starting from the $n^{th}$ row of pixels and stopping at the $m^{th}$ row of pixels.

Specifically, as shown in FIG. 6, in a first time period, the starting signal STV of the GOA unit at the $n^{th}$ stage of the gate driving circuit is at a high level, the first control signal Con1 is at a high level, and the second control signal Con2 is at a low level; in a second time period, the first control signal Con1 is restored to be at a low level, the second control signal Con2 is restored to be at a high level, and the starting signal STV is restored to be at a low level; in a third time period, the signal G(m−1) output by the output terminal 3 of the GOA unit 11 at the $(m-1)^{th}$ stage is at a high level, the first control signal Con1 is at the high level, the second control signal Con2 is at the low level, and the starting signal STV is kept at the low level; in a fourth time period, the signal G (m−1) output from the output terminal 3 of the GOA unit 11 at the $(m-1)^{th}$ stage becomes at a low level, and at the same time, the first control signal Con1 is restored to be at the low level, the second control signal Con2 is restored to be at the high level, and the starting signal STV is kept at the low level.

Specifically, when the gate driving circuit starts scanning the $n^{th}$ row of pixels, in the GOA unit 11 at the $n^{th}$ stage, the starting signal STV is at a high level, the first control signal Con1 is at a high level, the second control signal Con2 is at a low level, and the starting thin film transistor M5 is turned on and the scanning thin film transistor M6 is turned off. At this time, the starting signal STV is input into the source electrode of the starting thin film transistor M5 of the GOA unit 11 at the $n^{th}$ stage, the signal G(n) output from the output terminal 3 of the GOA unit 11 at the $n^{th}$ stage becomes at a high level, and the gate driving circuit starts scanning the $n^{th}$ row of pixels in the pixel array. When the signal G(n) output by the output terminal 3 of the GOA unit 11 at the $n^{th}$ stage is changed to be at a high level, the first control signal Con1 and the starting signal STV are restored simultaneously to be at the low level, and the second control signal Con2 is restored to be at the high level, so that in the GOA unit 11 cascaded after the GOA unit 11 at the $n^{th}$ stage, the scanning thin film transistor M6 is turned on, the starting thin film transistor M5 is turned off, and the signal G(n) output by the output terminal 3 of the GOA unit 11 at the $n^{th}$ stage controls the GOA unit 11 at the $(n+1)^{th}$ stage to scan the $(n+1)^{th}$ row of pixels, and so on, and thus the gate driving circuit performs row-by-row scanning on the pixel array starting from the $n^{th}$ row of pixels. When the signal G(m−1) output from the output terminal 3 of the GOA unit 11 at the $(m-1)^{th}$ stage becomes at a high level, the first control signal Con1 becomes at a high level, the second control signal Con2 becomes at a low level, and in the GOA unit 11 at any other stage other than the first stage, the starting thin film transistor M5 is turned on and the scanning thin film transistor M6 is turned off, and at this time, the starting signal STV is kept at the low level, and is input into the source electrode of the starting thin film transistor M5 of the GOA unit 11 at the $m^{th}$ stage, and since the scanning thin film transistor M6 is turned off, the signal G(m−1) output from the output terminal 3 of the GOA unit 11 at the $(m-1)^{th}$ stage cannot be input to the GOA unit 11 at the $m^{th}$ stage. The signal G(m) output by the output terminal 3 of the GOA unit 11 at the $m^{th}$ stage is at a low level, and thus the gate driving circuit stops scanning the $m^{th}$ row of pixels.

In summary, the gate driving circuit according to the embodiment of the disclosure can implement partial scanning the pixel array, can partially operate, and thus resulting in relative low power consumption.

Figure 7:
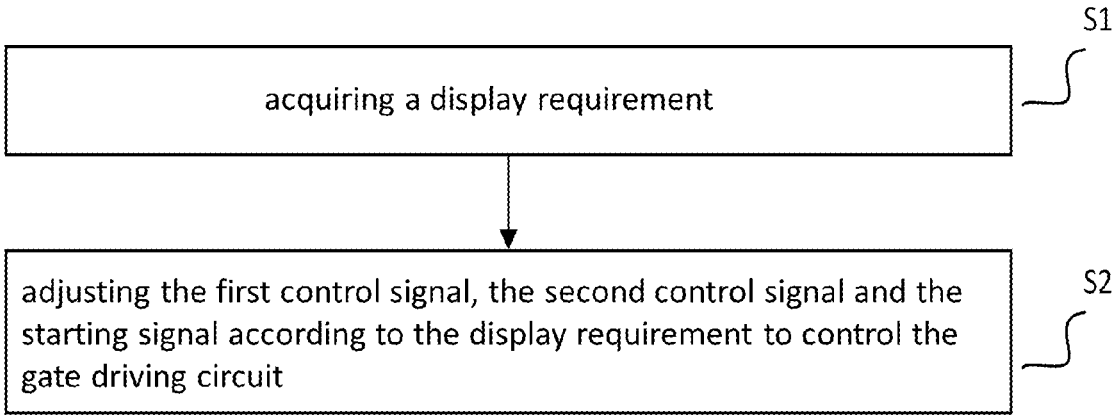
FIG. 7 is a flowchart of a driving method of a gate driving circuit according to an embodiment of the present disclosure.

FIG. 7 is a flowchart of a driving method of a gate driving circuit according to an embodiment of the present disclosure.

As shown in FIG. 7, the driving method of the gate driving circuit includes the following steps S1 and S2.

At S1, a display requirement is acquired.

Specifically, the display requirement is an area of the pixel array required to perform display, and the gate driving circuit can determine the GOA unit required to be started according to the area.

At S2, the first control signal, the second control signal and the starting signal are adjusted according to the display requirement to control the gate driving circuit.

In particular, in some implementations, the display requirement is to enable the gate driving circuit to perform row-by-row scanning on the pixel array starting from the first row of pixels. To start scanning the first row of pixels, the first control signal needs to be at a low level, the second control signal needs to be at a high level, and the starting signal needs to be at a high level.

In some implementations, the display requirement is to enable the gate driving circuit to perform row-by-row scanning on the pixel array starting from the $n^{th}$ row of pixels, where n is an integer greater than 1. Before starting scanning the $n^{th}$ row of pixels, the first control signal is at a low level, the second control signal is at a high level, and the starting signal is at a low level. When starting scanning the $n^{th}$ row pixels, in the GOA unit at the $n^{th}$ stage of the gate driving circuit, the starting signal becomes at a high level, the first control signal becomes at a high level, and the second control signal becomes at a low level. When the output of the output terminal of the GOA unit at the $n^{th}$ stage of the gate driving circuit is changed to be at a high level, the first control signal is restored to be at the low level, the second control signal is restored to be at the high level, and the starting signal is restored to be at the low level.

In some implementations, the display requirement is to enable the gate driving circuit to stop scanning the $m^{th}$ row of pixels, where m is an integer greater than 1. Before stopping scanning the $m^{th}$ row of pixels, the gate driving circuit performs row-by-row scanning on the pixel array starting from the first row of pixels, the first control signal is at a low level, the second control signal is at a high level, and when the output of the output terminal of the GOA unit at the first stage of the gate driving circuit becomes at a high level, the starting signal becomes at a low level. When the output of the output terminal of the GOA unit at the $(m-1)^{th}$ stage of the gate driving circuit is changed to be at a high level, the first control signal is changed to be at a high level, the second control signal is changed to be at a low level, and the starting signal is kept at the low level. When the output of the output terminal of the GOA unit at the $(m-1)^{th}$ stage of the gate driving circuit is changed to be at a low level, the first control signal is restored to be at the low level, the second control signal is restored to be at the high level, the starting signal is kept at the low level, and therefore the gate driving circuit stops scanning the $m^{th}$ row of pixels.

In some implementations, the display requirement is to enable the gate driving circuit to perform scanning on the pixel array starting from the $n^{th}$ row of pixels and stopping at the $m^{th}$ row of pixels, where n is an integer greater than 1, and m is an integer greater than n. When starting scanning the $n^{th}$ row of pixels, in the GOA unit at the $n^{th}$ stage of the gate driving circuit, the starting signal is at a high level, the first control signal is at a high level, and the second control signal is at a low level. When the output of the output terminal of the GOA unit at the $n^{th}$ stage of the gate driving circuit becomes at a high level, the starting signal becomes at a low level, the first control signal becomes at a high level, and the second control signal becomes at a low level, so that the gate driving circuit performs row-by-row scanning on the pixel array starting from the $n^{th}$ row of pixels. When the output of the output terminal of the GOA unit at the $(m-1)^{th}$ stage is changed to be at a high level, the first control signal is changed to be at a high level, and the second control signal is changed to be at a low level, so that the output of the output terminal of the GOA unit at the $(m-1)^{th}$ stage cannot be input into the GOA unit at the $m^{th}$ stage, the starting signal is kept at the low level and is input into the GOA unit at the $m^{th}$ stage, and thus the output of the output terminal of the GOA unit at the $m^{th}$ stage is at a low level, and the gate driving circuit stops scanning the $m^{th}$ row of pixels.

It should be noted that, for specific details of the driving method of the gate driving circuit, reference may be made to the above detailed description of the gate driving circuit, and details are not described here again.

The driving method of the gate driving circuit controls the gate driving circuit by adjusting the first control signal, the second control signal and the starting signal according to the display requirement, and therefore a partial scanning of the pixel array can be achieved, and the gate driving circuit can partially operate, resulting in relative low power consumption.

Figure 8:
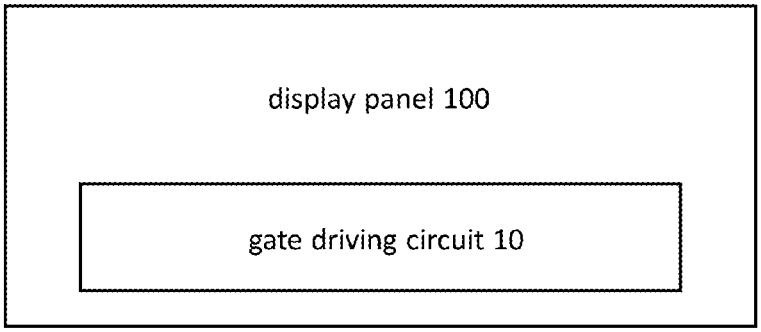
FIG. 8 is a block diagram of a display panel according to an embodiment of the present disclosure.

FIG. 8 is a block diagram of a display panel according to an embodiment of the present disclosure.

As shown in FIG. 8, the display panel 100 according to the embodiment of the present disclosure includes the gate driving circuit 10 in the above-described embodiment.

The display panel according to the embodiment of the present disclosure further includes a pixel array, and the gate driving circuit 10 is configured to drive the pixel array.

It should be understood that the display panel according to the embodiment of the present disclosure may further include other necessary or optional components known to those ordinary skills in the art, which are not specifically limited herein.

The display panel according to the embodiment of the present disclosure includes the gate driving circuit in the above embodiment, and thus can implement a partial display, resulting in relative low power consumption.

Figure 9:
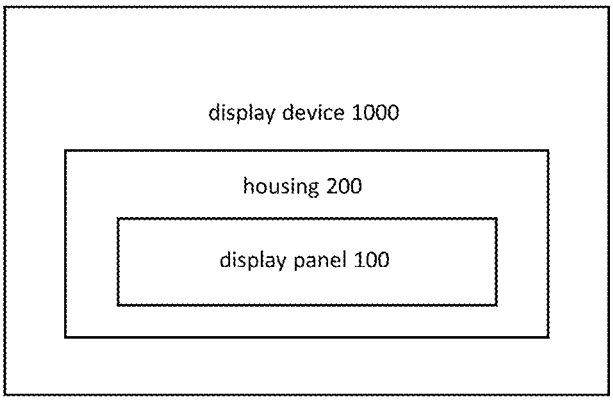
FIG. 9 is a block diagram of a display device according to an embodiment of the present disclosure.

FIG. 9 is a block diagram of a display device according to an embodiment of the present disclosure.

As shown in FIG. 9, a display device 1000 according to the embodiment of the present disclosure includes a housing 200 and the display panel 100 in the above-described embodiment, and the display panel 100 is disposed in the housing 200.

It should be understood that the display device 1000 may further include other necessary or optional components (e.g., power supply, etc.) known to those ordinary skills in the art, which are not specifically limited herein.

The display device according to the embodiment of the present disclosure includes the display panel in the above embodiment, and thus can realize a partial display, resulting in relative low power consumption.

It should be noted that logics and/or steps represented in the flowchart or otherwise described herein may be considered, for example, as an ordered listing of executable instructions for implementing logical functions, may be embodied in any computer-readable medium for use by or in connection with an instruction execution system, apparatus, or device, such as a computer-based system, processor-containing system, or other system that can fetch the instructions from the instruction execution system, apparatus, or device and execute the instructions. The computer-readable medium may contain any means that store, communicate, propagate, or transport a program for use by or in connection with the instruction execution system, apparatus, or device. More specific (non-exhaustive) examples of the computer-readable medium include an electrical coupling part (electronic device) having one or more wires, a portable computer diskette (magnetic device), a Random Access Memory (RAM), a read-only memory (ROM), an erasable programmable read-only memory (EPROM or flash memory), an optical fiber device, and a portable compact disc read-only memory (CDROM). Further, the computer readable medium may even be paper or another suitable medium upon which the program is printed, because the program may be electronically acquired, via, for instance, optical scanning the paper or other medium, compiled, interpreted or otherwise processed in a suitable manner if necessary, and then stored in a computer memory.

It should be understood that portions of the present disclosure may be implemented in hardware, software, firmware, or a combination thereof. In the above embodiments, various steps of the method may be implemented in software or firmware stored in a memory and executed by a suitable instruction execution system. For example, if the steps are implemented in hardware, any one or a combination of the following technologies, which are well known in the art, may be used: a discrete logic circuit having a logic gate circuit for implementing a logic function on a data signal, an application specific integrated circuit having an appropriate combinational logic gate circuit, a Programmable Gate Array (PGA), a Field Programmable Gate Array (FPGA), or the like.

In the description herein, descriptions referring to the terms "embodiment", "implementation", "example" or the like are intended to mean that a particular feature, structure, or characteristic described in connection with the embodiment, implementation, or example is included in at least one embodiment, implementation, or example of the present disclosure. In this specification, schematic representations of the above terms do not necessarily refer to the same embodiment, implementation, or example. Furthermore, particular features, structures, or characteristics described may be combined in any suitable manner in any one or more of embodiments, implementations, or examples.

In the description of the present disclosure, it should be understood that the terms "first", "second", and the like are used for descriptive purposes only and are not to be construed as indicating or implying relative importance or to implicitly indicate the number of technical features indicated. Thus, a feature defined by the term "first" or "second" may explicitly or implicitly include at least one of the feature. In the description of the present disclosure, "a plurality" means at least two, e.g., two, three, etc., unless explicitly defined otherwise.

In the present disclosure, unless otherwise explicitly stated or limited, the term "coupled" and the like are to be understood broadly, e.g., may be fixedly coupled, detachably coupled, or integrated; may be mechanically or electrically coupled; may be directly coupled or indirectly coupled through intervening media, or may be inter-coupled within two elements or in a relationship where the two elements interact with each other, unless otherwise specifically limited. The specific meaning of the above terms in the present disclosure may be understood by a person of ordinary skill in the art according to a specific case.

Although embodiments of the present disclosure have been shown and described above, it will be understood that the above embodiments are exemplary and not to be construed as limiting the present disclosure, and that those skilled in the art may make changes, modifications, substitutions and alterations to the above embodiments within the scope of the present disclosure, which should be construed as falling within the scope of the present disclosure.

The invention claimed is:

1. A gate driving circuit for driving a pixel array, and the gate driving circuit comprises a plurality of Gate Driver On Array (GOA) units which are cascaded, each of the GOA units drives a row of pixels, each of the GOA units comprises a starting sub-unit, an output sub-unit and an output terminal which are coupled in sequence, wherein, the starting sub-unit of the GOA unit at a first stage is coupled with a starting signal, a first control signal, a second control signal and a constant voltage potential respectively, and the output sub-unit of the GOA unit at the first stage is coupled with a first clock signal and a first power supply signal respectively;

the starting sub-unit of the GOA unit at an $n^{th}$ stage is coupled with the starting signal, the first control signal, the second control signal and the output terminal of the GOA unit at an $(n-1)^{th}$ stage respectively, the output sub-unit of the GOA unit at the $n^{th}$ stage is coupled with the first power supply signal and the output terminal of the GOA unit an $(n+1)^{th}$ stage, wherein n is an integer greater than 1, and in response to that n is an odd number, the output sub-unit of the GOA unit at the $n^{th}$ stage is further coupled with the first clock signal, and in response to that n is an even number, the output sub-unit of the GOA unit at the $n^{th}$ stage is further coupled with the second clock signal, the gate driving circuit starts or stops scanning a corresponding row of pixels of the pixel array according to the first control signal, the second control signal and the starting signal, wherein the output sub-unit of the GOA unit at each stage comprises:

a first thin film transistor, a gate electrode and a source electrode of the first thin film transistor are coupled to each other;

a second thin film transistor, a gate electrode of the second thin film transistor is coupled to a drain electrode of the first thin film transistor to form a first node, a source electrode of the second thin film transistor is coupled to the first clock signal or the second clock signal, and a drain electrode of the second thin film transistor is coupled to an output terminal of the GOA unit at a current stage;

a third thin film transistor, a gate electrode of the third thin film transistor is coupled to the output terminal of the GOA unit at a next stage, a source electrode of the third thin film transistor is coupled to the first node, and a drain electrode of the third thin film transistor is coupled with the first power supply signal; and a fourth thin film transistor, a gate electrode of the fourth thin film transistor is coupled to the output terminal of the GOA unit at the next stage, a source electrode of the fourth thin film transistor is coupled to the drain electrode of the second thin film transistor, and a drain electrode of the fourth thin film transistor is coupled with the first power supply signal.

2. The gate driving circuit of claim 1, wherein the starting sub-unit of the GOA unit at each stage comprises a starting thin film transistor and a scanning thin film transistor, in the starting sub-unit of the GOA unit at the first stage, a gate electrode of the starting thin film transistor is coupled with the second control signal, a source electrode of the starting thin film transistor is coupled with the starting signal, a drain electrode of the starting thin film transistor is coupled to the gate electrode of the first thin film transistor, a gate electrode of the scanning thin film transistor is coupled with the first control signal, a source electrode of the scanning thin film transistor is coupled with the constant voltage potential, and a drain electrode of the scanning thin film transistor is coupled to the gate electrode of the first thin film transistor;

in the starting sub-unit of the GOA unit at the $n^{th}$ stage, a gate electrode of the starting thin film transistor is coupled with the first control signal, a source electrode of the starting thin film transistor is coupled with the starting signal, a drain electrode of the starting thin film transistor is coupled to the gate electrode of the first thin film transistor, a gate electrode of the scanning thin film transistor is coupled with the second control signal, a source electrode of the scanning thin film transistor is coupled to the output terminal of the GOA unit at the $(n-1)^{th}$ stage, and a drain electrode of the scanning thin film transistor is coupled to the gate electrode of the first thin film transistor.

3. The gate driving circuit of claim 2, wherein the first clock signal and the second clock signal are out of phase by one-half clock cycle.

4. The gate driving circuit of claim 1, wherein the constant voltage potential is a constant voltage low potential, and the first power supply signal is a low level signal.

5. A display panel, comprising a pixel array and the gate driving circuit as claimed in claim 1, wherein the gate driving circuit is configured for driving the pixel array.

6. A display device, comprising a housing and the display panel according to claim 5, wherein the display panel is provided in the housing.

7. A driving method applied to a gate driving circuit, the gate driving circuit comprises a plurality of Gate Driver On Array (GOA) units which are cascaded, each of the GOA units drives a row of pixels, each of the GOA units comprises a starting sub-unit, an output sub-unit and an output terminal which are coupled in sequence, wherein, the starting sub-unit of the GOA unit at a first stage is coupled with a starting signal, a first control signal, a second control signal and a constant voltage potential respectively, and the output sub-unit of the GOA unit at the first stage is coupled with a first clock signal and a first power supply signal respectively;

the starting sub-unit of the GOA unit at an $n^{th}$ stage is coupled with the starting signal, the first control signal, the second control signal and the output terminal of the GOA unit at an $(n-1)^{th}$ stage respectively, the output sub-unit of the GOA unit at the $n^{th}$ stage is coupled with the first power supply signal and the output terminal of the GOA unit an $(n+1)^{th}$ stage, wherein n is an integer greater than 1, and in response to that n is an odd number, the output sub-unit of the GOA unit at the $n^{th}$ stage is further coupled with the first clock signal, and in response to that n is an even number, the output sub-unit of the GOA unit at the $n^{th}$ stage is further coupled with the second clock signal, the gate driving circuit starts or stops scanning a corresponding row of pixels of the pixel array according to the first control signal, the second control signal and the starting signal, the driving method comprising:

acquiring a display requirement;

adjusting the first control signal, the second control signal and the starting signal according to the display requirement to control the gate driving circuit, wherein the display requirement is to enable the gate driving circuit to stop scanning an $m^{th}$ row of pixels, wherein m is an integer greater than 1, before controlling the gate driving circuit to stop scanning the $m^{th}$ row of pixels, the first control signal is adjusted to be at a low level, the second control signal is adjusted to be at a high level, the gate driving circuit is controlled to perform row-by-row scanning on the pixel array starting from the first row of pixels, and in response to that an output of the output terminal of the GOA unit at the first stage of the gate driving circuit is changed to be at a high level, the starting signal is adjusted to be at a low level, in response to that an output of the output terminal of the GOA unit at an $(m-1)^{th}$ stage of the gate driving circuit is changed to be at a high level, the first control signal is adjusted to be at a high level, the second control signal is adjusted to be at a low level, the starting signal is kept at the low level, in response to that the output of the output terminal of the GOA unit at the $(m-1)^{th}$ stage of the gate driving circuit is changed to be at a low level, the first control signal is restored to be at the low level, the second control signal is restored to be at the high level, and the starting signal is kept at the low level to control the gate driving circuit to stop scanning the $m^{th}$ row of pixels.

8. The driving method of claim 7, wherein the display requirement is to enable the gate driving circuit to perform row-by-row scanning on the pixel array starting from an $n^{th}$ row of pixels, wherein n is an integer greater than 1, before controlling the gate driving circuit to start scanning the $n^{th}$ row of pixels, the first control signal is adjusted to be at a low level, the second control signal is adjusted to be at a high level, and the starting signal is adjusted to be at a low level, in response to that the gate driving circuit is controlled to start scanning the $n^{th}$ row of pixels, in the GOA unit at the $n^{th}$ stage of the gate driving circuit, the starting signal is adjusted to be at a high level, the first control signal is adjusted to be at a high level, the second control signal is adjusted to be at a low level, in response to that an output of the output terminal of the GOA unit at the $n^{th}$ stage of the gate driving circuit is changed to be at a high level, the first control signal is restored to be at the low level, the second control signal is restored to be at the high level, and the starting signal is restored to be at the low level.

9. The driving method of claim 7, wherein the display requirement is to enable the gate driving circuit to perform scanning on the pixel array starting from the $n^{th}$ row of pixels and stopping at the $m^{th}$ row of pixels, wherein n is an integer greater than 1, m is an integer greater than n, in response to that the gate driving circuit is controlled to start scanning the $n^{th}$ row of pixels, in the GOA unit at the $n^{th}$ stage of the gate driving circuit, the starting signal is adjusted to be at a high level, the first control signal is adjusted to be at a high level, the second control signal is adjusted to be at a low level, in response to that an output of the output terminal of the GOA unit at the $n^{th}$ stage of the gate driving circuit is changed to be at a high level, the starting signal is adjusted to be at a low level, the first control signal is adjusted to be at a low level, the second control signal is adjusted to be at a high level so as to control the gate driving circuit to perform row-by-row scanning on the pixel array from the $n^{th}$ row of pixels, in response to that an output of the output terminal of the GOA unit at the $(m-1)^{th}$ stage of the gate driving circuit is changed to be at a high level, the first control signal is adjusted to be at the high level, and the second control signal is adjusted to be at the low level, so that the output of the output terminal of the GOA unit at the $(m-1)^{th}$ stage of the gate driving circuit cannot be input into the GOA unit at the $m^{th}$ stage of the gate driving circuit, the starting signal is kept at the low level, and is input into the GOA unit at the $m^{th}$ stage of the gate driving circuit, the output of the output terminal of the GOA unit at the $m^{th}$ stage of the gate driving circuit is at a low level, to control the gate driving circuit to stop scanning the $m^{th}$ row of pixels.

10. A gate driving circuit for driving a pixel array, and the gate driving circuit comprises a plurality of Gate Driver On Array (GOA) units which are cascaded, the GOA unit at each stage drives a row of pixels, and the GOA unit at each stage comprises a first thin film transistor, a second thin film transistor, a third thin film transistor, a fourth thin film transistor, a starting thin film transistor and a scanning thin film transistor, a gate electrode and a source electrode of the first thin film transistor are coupled to each other;

a gate electrode of the second thin film transistor is coupled to a drain electrode of the first thin film transistor to form a first node, a source electrode of the second thin film transistor is coupled with a first clock signal or a second clock signal, and a drain electrode of the second thin film transistor is coupled to an output terminal of the GOA unit at a current stage;

a gate electrode of the third thin film transistor is coupled to an output terminal of the GOA unit at a next stage, a source electrode of the third thin film transistor is coupled to the first node, and a drain electrode of the third thin film transistor is coupled with a first power supply signal;

a gate electrode of the fourth thin film transistor is coupled to the output terminal of the GOA unit at the next stage, a source electrode of the fourth thin film transistor is coupled to the drain electrode of the second thin film transistor, and a drain electrode of the fourth thin film transistor is coupled with the first power supply signal;

in the GOA unit at a first stage, a gate electrode of the starting thin film transistor is coupled with a second control signal, a source electrode of the starting thin film transistor is coupled with a starting signal, a drain electrode of the starting thin film transistor is coupled to the gate electrode of the first thin film transistor, a gate electrode of the scanning thin film transistor is coupled with a first control signal, a source electrode of the scanning thin film transistor is coupled with a constant voltage potential, and a drain electrode of the scanning thin film transistor is coupled to the gate electrode of the first thin film transistor;

in a starting sub-unit of the GOA unit at an $n^{th}$ stage, a gate electrode of the starting thin film transistor is coupled with the first control signal, a source electrode of the starting thin film transistor is coupled with the starting signal, a drain electrode of the starting thin film transistor is coupled to the gate electrode of the first thin film transistor, a gate electrode of the scanning thin film transistor is coupled with the second control signal, a source electrode of the scanning thin film transistor is coupled to an output terminal of the GOA unit at an $(n-1)^{th}$ stage, a drain electrode of the scanning thin film transistor is coupled to the gate electrode of the first thin film transistor, wherein n is an integer greater than 1, in response to that n is an odd number, the source electrode of the second thin film transistor of the GOA unit at the $n^{th}$ stage is coupled with the first clock signal, and in response to that n is an even number, the source electrode of the second thin film transistor of the GOA unit at the $n^{th}$ stage is coupled with the second clock signal.

* * * * *